US007157858B2

(12) United States Patent
Sato et al.

(10) Patent No.: US 7,157,858 B2
(45) Date of Patent: Jan. 2, 2007

(54) SELF LIGHT EMITTING DISPLAY MODULE, ELECTRONIC EQUIPMENT INTO WHICH THE SAME MODULE IS LOADED, AND INSPECTION METHOD OF DEFECT STATE IN THE SAME MODULE

(75) Inventors: Hiroyuki Sato, Yonezawa (JP); Takashi Goto, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 109 days.

(21) Appl. No.: 11/085,186

(22) Filed: Mar. 22, 2005

(65) Prior Publication Data

US 2005/0212730 A1 Sep. 29, 2005

(30) Foreign Application Priority Data

Mar. 24, 2004 (JP) ..... 2004-086104

(51) Int. Cl.
*G09G 37/00* (2006.01)
*G09G 3/32* (2006.01)

(52) U.S. Cl. ..... 315/169.3; 345/76

(58) Field of Classification Search ..... 315/169.1, 315/169.3, 169.4; 345/55, 70, 76, 84, 96
See application file for complete search history.

(56) References Cited

U.S. PATENT DOCUMENTS 6,243,069 B1 * 6/2001 Ogawa et al. ..... 345/102
6,545,653 B1 * 4/2003 Takahara et al. ..... 345/87
6,903,716 B1 * 6/2005 Kawabe et al. ..... 345/99
7,088,325 B1 * 8/2006 Ishii ..... 345/89

FOREIGN PATENT DOCUMENTS

JP 3437152 6/2003

* cited by examiner

*Primary Examiner*—Tuyet Vo
*Assistant Examiner*—Minh Dieu A
(74) *Attorney, Agent, or Firm*—Westerman, Hattori, Daniels & Adrian, LLP.

(57) ABSTRACT

In a detection mode, a reverse bias voltage VM is applied to any one of scan lines K1–Km arranged in a light emitting display panel 1. The electrical potentials generated at respective data lines A1–An of this time are supplied to potential determination means J1–Jn. In the potential determination means J1–Jn, the electrical potentials generated at the respective data lines A1–An are supplied to switching elements Q31–Q3*n* via transfer switches Q11–Q1*n*. When the electrical potentials are the threshold voltages of the switching elements Q31–Q3*n* or greater, the outputs of comparators CP1–CPn are inverted, and the states of this time are latched in latch circuits LC1–LCn to be stored in a data register 11. By data stored in the data register 11, it is determined whether or not a defect has occurred in pixels of the display panel, and the location thereof is also determined.

20 Claims, 3 Drawing Sheets

SELF LIGHT EMITTING DISPLAY MODULE, ELECTRONIC EQUIPMENT INTO WHICH THE SAME MODULE IS LOADED, AND INSPECTION METHOD OF DEFECT STATE IN THE SAME MODULE

BACKGROUND OF THE INVENTION

1. Field of the Invention

The present invention relates to a self light emitting display module provided with a light emitting display panel in which for example organic EL (electroluminescent) elements are employed for pixels as self light emitting elements and drive means to drive and light this panel, and particularly to a self light emitting display module having a function that can generally inspect a state in which a defect is occurring in the self light emitting elements in the light emitting display panel and an inspection method of a defect state in the same module.

2. Description of the Related Art

A display has been installed in many of electronic equipment or the like which have been provided presently, and this display has been necessary and indispensable as a man-machine interface of equipment supporting information-oriented society. In a case where the above-mentioned display is employed in a field in which there is a possibility that trouble in display such as for example of a meter of medical equipment or airplanes and the like may influence a human life, a stricter reliability in a display is required than in a display adopted in consumer equipment such as a portable telephone, car audio, and the like.

For example, regarding injection equipment for a medicine or the like, in the case where a bright leak phenomenon occurs in the scan direction on a portion displaying figures showing an injection amount, a problem that whether a displayed figure is "0" or "8" cannot be determined may occur. A problem which may occur is that pixels of a part on which a decimal point is displayed are not lit so that the place for the figures is erroneously displayed so that the figures are read while this is not being noticed or the like. It is extremely dangerous for a user to keep using the above-described equipment while perceiving display in a troubled state being normal, and it is needless to say that such a state may develop a serious problem.

Thus, in the display employed in the above-mentioned electronic equipment, in a state of semi-finished goods before the product is shipped, a defect state regarding each pixel arranged in a display panel has been inspected to determine whether or not the degree of defect meets the standard of a product into which this display is loaded (for example, see Japanese Patent No. 3437152).

Meanwhile, the invention disclosed in Japanese Patent No. 3437152 is to execute evaluation of each pixel of a display panel in a state of semi-finished goods before the product is shipped, and an object thereof is to provide an evaluation device through which evaluation results having high reliability can be obtained utilizing a drive circuit for inspecting an organic EL display.

In a case where the evaluation device disclosed in Japanese Patent No. 3437152 is utilized, although an effect that an initial defect of a product can be detected to deal with the defect before the display panel having the defect is delivered to a user can be produced, this type of display has a problem that a defect may newly occur in pixels arranged in a display panel while the display unit is in operation after shipment of the product.

Thus, various countermeasures for keeping the extent that such a defect occurs at a minimum to ensure reliability have been adopted. However, to overcome the problem of defect of pixels occurring during the operation of the display or the like or the problem that defect occurs in the above-mentioned drive means or the like, extremely numerous technical problems exist, and we have to say that it is difficult to provide a display module in which the above-mentioned defect does not occur after the shipment of the product.

SUMMARY OF THE INVENTION

The present invention has been developed as attention to the above-described realistic problems has been paid, and it is an object of the present invention to provide a self light emitting display module which is provided with a detection means which can inspect whether or not there is a defect occurring in the display panel and by which when a defect of pixels occurs, this state can be reported to a user so that erroneous display information can be prevented from being conveyed to the user and an inspection method of a defect state in the same module.

A self light emitting display module according to the present invention made to carry out the above-described object is a self light emitting display module comprising a self light emitting display unit composed of a light emitting display panel in which a large number of pixels including self light emitting elements having a diode characteristic are arranged in a matrix pattern at intersection positions between scan lines and data lines and drive means for selectively driving and lighting the respective self light emitting elements in the light emitting display panel, trouble detection means for detecting trouble in the self light emitting display unit, and a memory means for storing detection results which are obtained by the trouble detection means, wherein the trouble detection means is constructed to comprise reverse bias voltage applying means for applying a reverse bias voltage to the cathode side of the self light emitting element in a non-light-emitting-state of said element and potential determination means for determining whether or not the electrical potential at the anode side of the self light emitting element in a state in which the reverse bias voltage is applied to the cathode side of said element is a predetermined value or greater, so that trouble in the self light emitting display unit is detected by the potential determination means.

An inspection method of a defect state in a self light emitting display module according to the present invention made to carry out the above-described object is an inspection method of a defect state in a self light emitting display module comprising a self light emitting display unit composed of alight emitting display panel in which a large number of pixels including self light emitting elements having a diode characteristic are arranged in a matrix pattern at intersection positions between scan lines and data lines and drive means for selectively driving and lighting the respective self light emitting elements in the light emitting display panel, trouble detection means for detecting trouble in the self light emitting display unit, and a memory means for storing detection results which are obtained by the trouble detection means, wherein the trouble detection means executes a reverse bias voltage applying step in which a reverse bias voltage is applied to any one of scan lines in the light emitting display panel, a potential determination step in which the electrical potential at the anode side of the element in a state in which the reverse bias voltage is applied is obtained via the data line and in which it is determined whether the electrical potential at the anode side of the element is a predetermined value or greater or not, a determination result storing step in which a determination result obtained by the potential determination step is stored in the memory means.

DESCRIPTION OF THE PREFERRED EMBODIMENT

Figure 1:
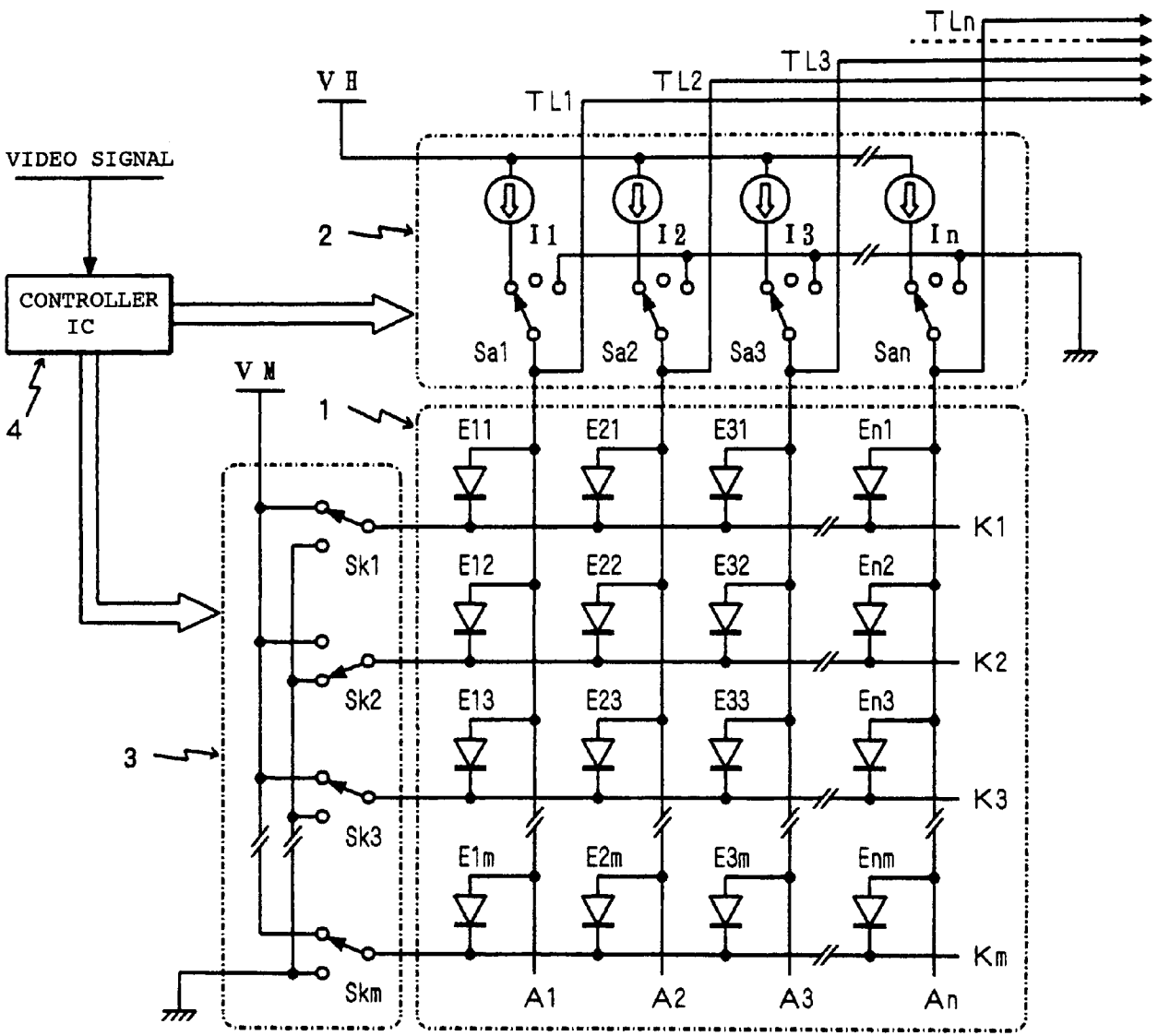
FIG. 1 is a circuit structure diagram showing one example of a self light emitting display unit according to the present invention.

A self light emitting display module according to the present invention will be described below with reference to the embodiment shown in the drawings. In the self light emitting display module according to the present invention, provided are a self light emitting display unit composed of a light emitting display panel in which a large number of self light emitting elements are arranged as pixels in a matrix pattern and drive means for selectively driving and lighting the respective light emitting elements in this light emitting display panel, and further provided are a trouble detection means for detecting trouble of a self light emitting display unit and a memory means for storing detection results of the trouble detection means. In the embodiments explained below, shown is an example in which organic EL elements in which an organic material is employed in a light emitting layer are adopted as the self light emitting elements.

The organic EL element can be electrically replaced by a structure composed of a light emitting component having a diode characteristic and a parasitic capacitance component which is connected in parallel to this light emitting component, and it can be said that the organic EL element is a capacitive light emitting element. When a light emission drive voltage is applied to this organic EL element in a forward direction, at first, electrical charges corresponding to the electric capacity of this element flow into the electrode as displacement current and are accumulated. It can be considered that when the light emission drive voltage then exceeds a predetermined voltage (light emission threshold voltage=Vth) peculiar to this element, current begins to flow from one electrode (anode side of the diode component) to an organic layer constituting the light emitting layer so that the element emits light at an intensity proportional to this current.

Meanwhile, regarding the organic EL element, due to reasons that the voltage-intensity characteristic thereof is unstable with respect to temperature changes while the current-intensity characteristic thereof is stable with respect to temperature changes and that degradation of the organic EL element is considerable when the organic EL element receives excess current so that the light emission lifetime is shortened, and the like, a constant current drive is performed in general. As display panels in which such organic EL elements are employed, a passive matrix type display panel in which EL elements are arranged in a matrix pattern and an active matrix type display panel in which respective EL elements arranged in a matrix pattern are driven to be lit respectively by TFTs (thin film transistors) have been proposed.

FIG. 1 shows an embodiment of a self light emitting module according to the present invention, and this shows an example employing the passive matrix type display panel. As drive methods for organic EL elements in this passive matrix type drive method, there are two methods, that is, cathode line scan/anode line drive and anode line scan/cathode line drive, and the structure shown in FIG. 1 shows a form of the former cathode line scan/anode line drive. That is, anode lines A1–An as n data lines are arranged in a vertical direction (column direction), cathode lines K1–Km as m scan lines are arranged in a horizontal direction (row direction), and organic EL elements E11–Enm designated by symbols/marks of diodes are arranged at positions at which the anode lines intersect the cathode lines (in total, n×m portions) to construct a display panel 1.

In the respective EL elements E11–Enm constituting pixels, one ends thereof (anode terminals in equivalent diodes of EL elements) are connected to the anode lines and the other ends thereof (cathode terminals in equivalent diodes of EL elements) are connected to the cathode lines, corresponding to respective intersection positions between the anode lines A1–An extending along the vertical direction and the cathode lines K1–Km extending along the horizontal direction. Further, the respective anode lines A1–An are connected to an anode line drive circuit 2 provided as a data driver constituting lighting drive means, and the respective cathode lines K1–Km are connected to a cathode line scan circuit 3 provided as a scan driver constituting the lighting drive means similarly, so as to be driven respectively.

The anode line drive circuit 2 is provided with constant current sources I1–In which utilize, to be operated, a drive voltage VH brought from a voltage boost circuit (not shown) for example by a DC—DC converter and drive switches Sa1–San, and the drive switches Sa1–San are connected to the constant current sources I1–In side so that currents from the constant current sources I1–In are supplied to the respective EL elements E11–Enm arranged corresponding to the cathode lines. In this embodiment, when currents from the constant current sources I1–In are not supplied to the respective EL elements, the drive switches Sa1–San can allow these anode lines to be connected to open terminals or a ground GND which is provided as a reference potential point.

The cathode line scan circuit 3 is equipped with scan switches Sk1–Skm corresponding to the respective cathode lines K1–Km, and these scan switches operate to allow either a reverse bias voltage VM for preventing cross talk light emission or the ground potential GND provided as the reference potential point to be connected to corresponding cathode lines. Thus, by allowing the constant current sources I1–In to be connected to desired anode lines A1–An while the cathode lines are set at the reference potential point (ground potential) at a predetermined cycle, the respective EL elements can be selectively illuminated.

A control bus is connected from a controller IC 4 including a CPU to the anode line drive circuit 2 and the cathode line scan circuit 3. Switching operations of the scan switches Sk1–Skm and the drive switches Sa1–San are performed based on a video signal to be displayed which is supplied to the controller IC 4. Thus, while the cathode scan lines are set to the ground potential at a predetermined cycle based on the video signal, the constant current sources I1–In are connected to desired anode lines. Accordingly, the respective light emitting elements are selectively illuminated so that an image based on the video signal is displayed on the display panel 1.

In the state shown in FIG. 1, the second cathode line K2 is set to the ground potential to be in a scan state, and at this time, the reverse bias voltage VM is applied to the cathode lines K1, K3–Km which are in a non-scan state. In the state shown in FIG. 1, all drive switches Sa1–San are selected to the respective constant current sources I1–In sides, and therefore respective EL elements whose cathodes are connected to the second cathode line K2 are all brought to the lighting state. In the case where these EL elements in the scan state are controlled to be brought to non-lighting, the drive switches Sa1–San are connected to the ground GND side provided as the reference potential point. The above is an explanation of a case where the self light emitting display unit is in a light emission drive mode.

In the case of the light emission drive mode, where the forward voltage of the EL element in a scan light emission state is VF, respective electrical potential points are set to meet a relationship of [(forward voltage VF)−(reverse bias voltage VM)]<(light emission threshold voltage Vth.) Thus, a voltage of the element's light emission threshold voltage Vth or lower is applied to the respective EL elements connected at the intersections between the driven anode lines and the cathode lines which are not selected for scanning (cathode lines of the non-scan state), so as to prevent the EL elements from emitting cross talk light.

The self light emitting display unit is composed of the light emitting display panel 1, the anode line drive circuit 2 and the cathode line scan circuit 3 as drive means, and the controller IC 4 which are described above. In the self light emitting display module shown in this FIG. 1, in addition to these, provided are a trouble detection means for detecting trouble in the self light emitting display unit and a memory means for storing detection results by this trouble detection means.

The structures of the trouble detection means and the memory means will be described below with reference to the embodiment shown in FIG. 2. Respective inspection lines TL1–TLn are drawn from connection positions between the anode line drive circuit 2 and the respective anode lines A1–An in the light emitting display panel 1, and the electrical potentials at these inspection lines TL1–TLn are supplied to respective potential determination means J1–Jn constituting the trouble detection means as shown in FIG. 2.

Figure 2:
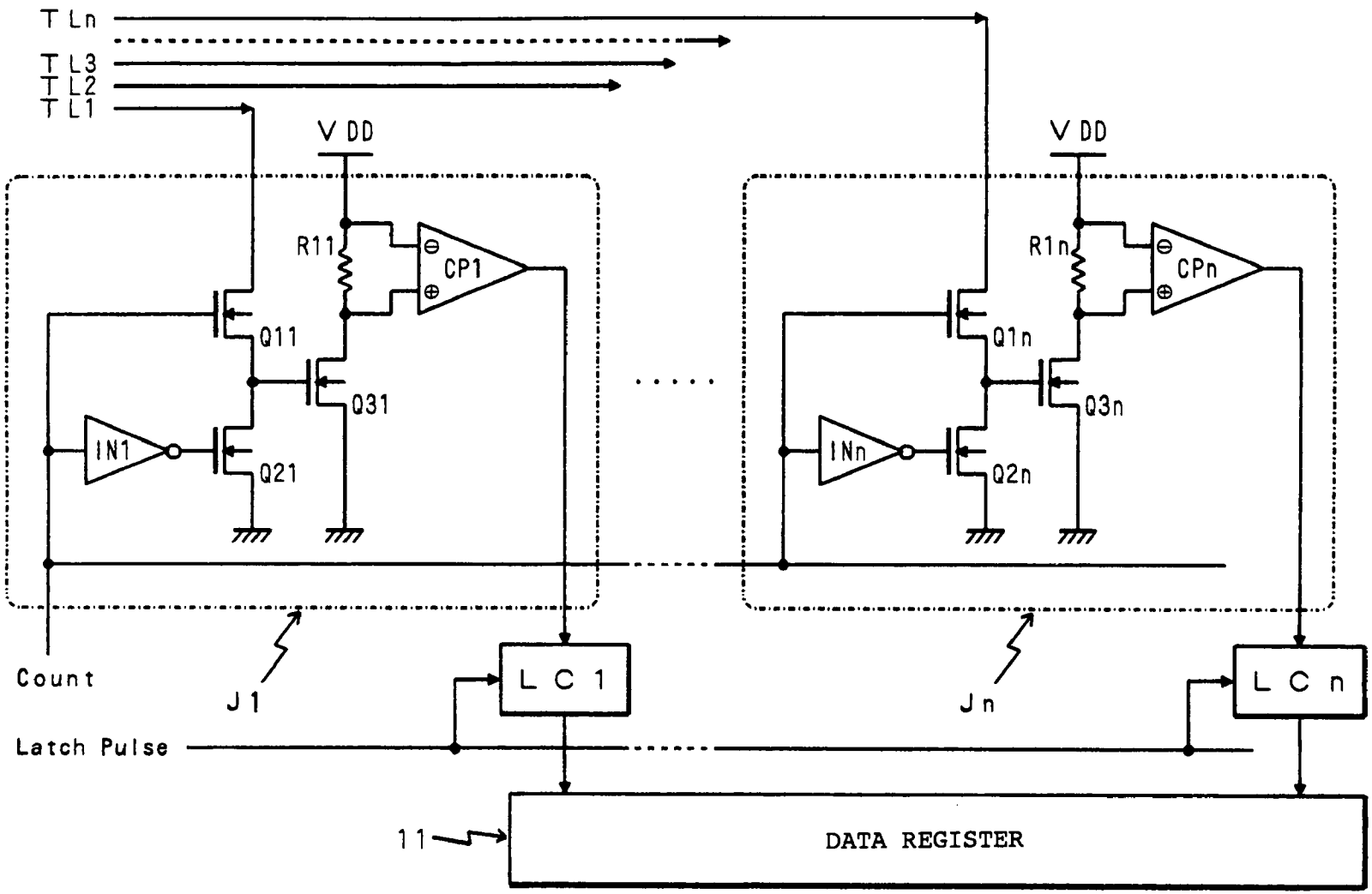
FIG. 2 is a circuit structure diagram explaining an example of the structure of detection means for detecting trouble in the self light emitting display unit shown in FIG. 1 and a memory means.

In the embodiment shown in FIG. 2, although the potential determination means J1–Jn are respectively provided corresponding to the respective anode lines A1–An in the light emitting display panel 1, in FIG. 2, for convenience of illustration, only the circuit structures of the potential determination means J1 connected to the anode line A1, that is, the inspection line TL1, and the potential determination means Jn connected to the anode line An, that is, the inspection line TLn, are shown. The respective potential determination means J1–Jn all have the same circuit structure, and the circuit structure of the first potential determination means J1 will be described below representatively.

The inspection potential supplied via the inspection line TL1 is supplied to the source of an n-channel type transistor designated by reference character Q11 which functions as a transfer switch. The drain of the transistor Q11 is connected to the drain of an n-channel type transistor designated by reference character Q21, and the source of the transistor Q21 is connected to the ground GND that is the reference potential point. Meanwhile, a control voltage is supplied from a control terminal (Count) to the gate of the transistor Q11 which functions as a transfer switch, and the control voltage whose logic level is inverted is supplied to the gate of the transistor Q21 via an inverter IN1.

The gate of an n-channel type transistor designated by reference character Q31 is connected to a connection point between the drain of the transistor Q11 and the drain of the transistor Q21, and the source of this transistor Q31 is connected to ground GND. Meanwhile, the drain of the transistor Q31 is connected to a logic operation power source VDD via a resistor R11 which functions as a voltage dropping element. The inverting input terminal of a comparator CP1 is coupled to the logic operation power source VDD, and the drain of the transistor Q31 is connected to the non-inverting input terminal of the comparator CP1 connected to the resistor R11.

The output from the comparator CP1 in the potential determination means J1 is supplied to a latch circuit LC1, and the output of the comparator CP1 is latched by a latch pulse inputted to this latch circuit LC1. Respective latch outputs by the latch circuit LC1 are supplied to a data register 11 constituting a memory means and can be stored in this data register 11.

The latch circuit described above is respectively provided corresponding to the respective potential determination means J1–Jn whose respective illustrations are omitted in FIG. 2, and the respective latch circuits LC1–LCn simultaneously receive the latch pulse so that the outputs at that time are respectively stored in the data register 11.

The self light emitting display module of the above-described structure is constructed to be switchable between the light emission drive mode already described and a detection mode described hereinafter, and for example when an operational power supply is turned on, or periodically in a state in which the operational power supply is turned on, or some arbitrary time by a factitious external operation, it can be switched to the detection mode.

In the case where it is switched to the detection mode, by a command from the controller IC 4, the drive switches Sa1–San in the anode line drive circuit 2 are all switched to the open terminal sides. Similarly, by a command from the controller IC 4, any one of the scan switches Sk1–Skm in the cathode line scan circuit 3 is connected to the reverse bias voltage VM side, and other scan switches are connected to the ground GND side.

That is, the scan switches Sk1–Skm and the reverse bias voltage VM constitute reverse bias voltage applying means in the case where switching to the detection mode is performed. Here, for example, suppose the case where only the scan switch Sk1 is connected to the reverse bias voltage VM side and other scan switches are connected to the ground side, with respect to respective EL elements whose cathodes are connected to the first scan line K1, it can be inspected as to whether there is trouble or not.

That is, in a case where a short circuited state has occurred in any one of the respective EL elements corresponding to the first scan line K1, the electrical potential of the VM is generated at the anode line corresponding to such an EL element. In other words, if all of the respective EL elements corresponding to the first scan line K1 are normal, the electrical potential of the VM is not generated at the respective anode lines A1–An.

Meanwhile, in the case where switching to the detection mode is performed, the control voltage is supplied to the respective potential determination means J1–Jn constituting the trouble detection means shown in FIG. 2 via the control terminal (Count). In this case, a control voltage of "H" (high) level is supplied to the control terminal, and thus the transistor Q11 functioning as a transfer switch in the first potential determination means J1 is brought to an ON state. Since a control voltage of control voltage "L" (low) level whose logic level is inverted is supplied to the gate of the transistor Q21 via the inverter IN1, the transistor Q21 is brought to an OFF state.

Accordingly, the electrical potential at the anode line A1 supplied via the first inspection line TL1 is supplied to the gate of the transistor Q31 constituting a switching element via the transistor Q11. Here, if the gate potential applied to the transistor Q31 is the threshold voltage of the transistor Q31 or greater, this is turned on. Therefore, current resulting from turning on of the transistor Q31 flows in the resistor R11 functioning as a voltage dropping element, and thus the output of the comparator CP1 changes from "+" (plus) to "−" (minus).

At this time, the latch pulse is supplied to the latch circuit LC1, and "−" that is latch data of this time is stored in the data register 11 provided as the memory means. Here, in the case where the latch data stored in the data register 11 is "−", it is determined that a defect of a short circuit has occurred in the EL element E11 in the light emitting display panel 1, and in the case where the latch data is "+", it is determined that the EL element E11 is normal.

Although the description above shows the operations of the first potential determination means J1 and the situation that the latch data of this time is stored in the data register 11, the operations are executed in all of the respective data lines A1–An via the respective inspection lines TL1–TLn at the same time.

In the case where the first potential determination means J1 is brought to the light emission drive mode, the control voltage of "L" level is supplied to the control terminal. Thus, the transistor Q11 is turned off, and the transistor Q21 is turned on. Accordingly, the transistor Q31 is turned off, and as a result, the transistor Q31 operates to prevent current from flowing from the logic operation power source VDD to the resistor R11 all the time.

Although the description above shows an example of the case where trouble of the respective EL elements is inspected during the detection mode while the first scan line K1 is a target, switching to the detection mode is performed again for example during a next one frame (or one subframe) period to inspect trouble of the respective EL elements corresponding to a next one scan line. In this manner, in combinations of all scan lines and the respective data lines, inspection is repeated respectively, and a series of inspections regarding the respective EL elements arranged in the display panel 1 are completed. The series of inspections are executed periodically again and can also be executed at some arbitrary time by a factitious external operation.

Figure 3:
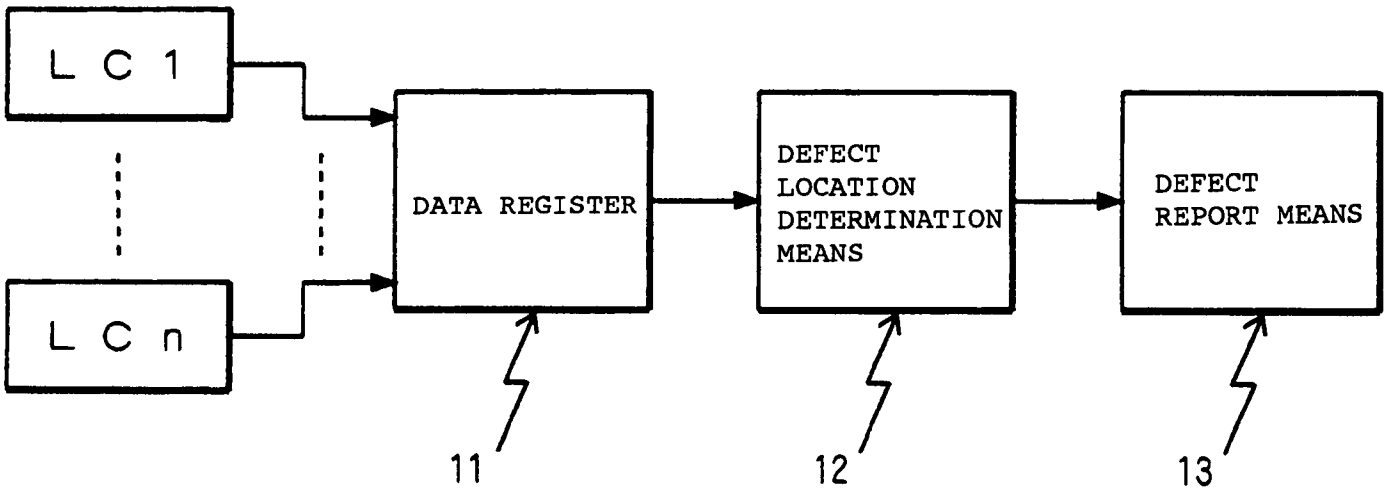
FIG. 3 is a block diagram showing an example of a connection structure of a defect location determination means and a defect report means which utilize data stored in the data register shown in FIG. 2.

FIG. 3 shows a structure that the location at which trouble (defect) exists can be identified so that defect report means can be operated accordingly, utilizing respective inspection results stored in the data register 11 described above, that is, the latch outputs from the latch circuits LC1–LCn. That is, reference numeral 11 shown in FIG. 3 designates the data register shown in FIG. 2, and the latch outputs corresponding to the respective scan lines stored in this data register 11 are utilized in the defect location determination means designated by reference numeral 12. A defect report means 13 is driven in accordance with a defect location determined in the defect location determination means 12.

In the data register 11, as already described, respective latch outputs corresponding to one scan line are stored at one time, and these can be stored in a state in which these are unfolded for example in a map-like state for each scan line. Accordingly, light emission trouble of all pixels by the EL elements arranged in the display panel can be detected, and the location (coordinate value) of a troubled EL element can also be detected.

The defect report means 13 is driven in accordance with the defect location determined in the defect location determination means 12. In this case, for example. even if it becomes clear that a defect has occurred in pixels, if the defect location is a position at which possibility of mistakenly recognizing display is low, an operation may be performed wherein the defect report means 13 is not operated so that the display panel is used as it is. For example, in the case where a defect location in pixels is of a position at which a decimal point is displayed, even if the number of pixels of defect is small, necessity of operating the defect report means 13 arises. It is desired that such a selection is appropriately set in accordance with equipment in which the present self light emitting display module is loaded.

As the defect report means 13, a means such as for example a buzzer which reports auditorily may be adopted, or a message reporting that a malfunction has occurred in the display panel 1 may be displayed. Or display of the display panel 1 may be extinguished so that it becomes apparent that there is a malfunction. In this case, if extinguishing display is not allowable such as for example in a case of a meter or the like which is used in an airplane, it may be considered that a means for appropriately changing display position is adopted.

In the embodiments described above, although organic EL elements are employed as self light emitting elements, these are not limited to the organic EL elements, and other self light emitting elements which are driven by current can be employed. Further, not only when the self light emitting display module including the trouble detection means is adopted in electronic equipment including a meter for medical equipment or airplanes already described, but also when it is adopted in other electronic equipment which calls for this type of light emitting display panel, operations and effects already described can be produced as they are.

What is claimed is:

1. A self light emitting display module comprising a self light emitting display unit composed of a light emitting display panel in which a large number of pixels including self light emitting elements having a diode characteristic are arranged in a matrix pattern at intersection positions between scan lines and data lines and drive means for selectively driving and lighting the respective self light emitting elements in the light emitting display panel, trouble detection means for detecting trouble in the self light emitting display unit, and a memory means for storing detection results which are obtained by the trouble detection means, wherein the trouble detection means is constructed to comprise reverse bias voltage applying means for applying a reverse bias voltage to the cathode side of the self light emitting element in a non-light-emitting-state of said element and potential determination means for determining whether or not the electrical potential at the anode side of the self light emitting element in a state in which the reverse bias voltage is applied to the cathode side of said element is a predetermined value or greater, so that trouble in the self light emitting display unit is detected by the potential determination means.

2. The self light emitting display module according to claim 1, wherein the reverse bias voltage applying means utilizes a voltage source which prevents the light emitting elements arranged at intersection points between driven data lines and a scan line of the non-scan state from being crosstalk lit by applying a predetermined voltage to a scan line of a non-scan state in a light emission drive operation of the light emitting display panel.

3. The self light emitting display module according to claim 2, wherein the drive means is constructed to be switchable between a light emission drive mode and a detection mode, wherein in the detection mode, supply of lighting drive current to the data lines is stopped by opening of a drive switch constituting the drive means, and the reverse bias voltage is applied to any one of the scan lines.

4. The self light emitting display module according to claim 1, wherein the drive means is constructed to be switchable between a light emission drive mode and a detection mode, wherein in the detection mode, supply of lighting drive current to the data lines is stopped by opening of a drive switch constituting the drive means, and the reverse bias voltage is applied to any one of the scan lines.

5. The self light emitting display module according to claim 1, wherein the potential determination means includes a switching element which performs a switching operation by an electrical potential which is of a predetermined value or greater at the anode side of the self light emitting element and which is generated on the data line.

6. The self light emitting display module according to claim 5, wherein in the potential determination means, a transfer switch is arranged which is turned on in the detection mode so that the electrical potential of the anode side of the self light emitting element is supplied to the switching element via said transfer switch.

7. The self light emitting display module according to claim 6, wherein the potential determination means further comprises a voltage dropping element in which a predetermined current flows by turning on of the switching element and a comparator whose output state is changed when the electrical potential between both ends of this voltage dropping element is at a predetermined value or greater, so that trouble in the self light emitting display unit is detected by the output state of said comparator.

8. The self light emitting display module according to claim 7, wherein the potential determination means are respectively arranged corresponding to the respective data lines so that the electrical potentials which are at the anode sides of the respective light emitting elements and which are obtained at the respective data lines can be determined at the same time.

9. The self light emitting display module according to claim 6, wherein the potential determination means are respectively arranged corresponding to the respective data lines so that the electrical potentials which are at the anode sides of the respective light emitting elements and which are obtained at the respective data lines can be determined at the same time.

10. The self light emitting display module according to claim 6, wherein a detection operation by the trouble detection means is respectively performed in all combinations between the respective scan lines and the respective data lines corresponding to the respective pixels in the light emitting display panel, and detection results based on the detection operations are stored in the memory means.

11. The self light emitting display module according to claim 5, wherein the potential determination means further comprises a voltage dropping element in which a predetermined current flows by turning on of the switching element and a comparator whose output state is changed when the electrical potential between both ends of this voltage dropping element is at a predetermined value or greater, so that trouble in the self light emitting display unit is detected by the output state of said comparator.

12. The self light emitting display module according to claim 11, wherein the potential determination means are respectively arranged corresponding to the respective data lines so that the electrical potentials which are at the anode sides of the respective light emitting elements and which are obtained at the respective data lines can be determined at the same time.

13. The self light emitting display module according to claim 5, wherein the potential determination means are respectively arranged corresponding to the respective data lines so that the electrical potentials which are at the anode sides of the respective light emitting elements and which are obtained at the respective data lines can be determined at the same time.

14. The self light emitting display module according to claim 5, wherein a detection operation by the trouble detection means is respectively performed in all combinations between the respective scan lines and the respective data lines corresponding to the respective pixels in the light emitting display panel, and detection results based on the detection operations are stored in the memory means.

15. The self light emitting display module according to claim 1, wherein the potential determination means are respectively arranged corresponding to the respective data lines so that the electrical potentials which are at the anode sides of the respective light emitting elements and which are obtained at the respective data lines can be determined at the same time.

16. The self light emitting display module according to claim 1, wherein a detection operation by the trouble detection means is respectively performed in all combinations between the respective scan lines and the respective data lines corresponding to the respective pixels in the light emitting display panel, and detection results based on the detection operations are stored in the memory means.

17. The self light emitting display module according to claim 1, wherein the self light emitting elements arranged in the light emitting display panel are organic EL elements in which an organic compound is employed in a light emitting layer.

18. Electronic equipment into which the self light emitting display module described in claim 1 is loaded.

19. An inspection method of a defect state in a self light emitting display module comprising a self light emitting display unit composed of a light emitting display panel in which a large number of pixels including self light emitting elements having a diode characteristic are arranged in a matrix pattern at intersection positions between scan lines and data lines and drive means for selectively driving and lighting the respective self light emitting elements in the light emitting display panel, trouble detection means for detecting trouble in the self light emitting display unit, and a memory means for storing detection results which are obtained by the trouble detection means, wherein the trouble detection means executes a reverse bias voltage applying step in which a reverse bias voltage is applied to any one of scan lines in the light emitting display panel, a potential determination step in which the electrical potential at the anode side of the element in a state in which the reverse bias voltage is applied is obtained via the data line and in which it is determined whether the electrical potential at the anode side of the element is a predetermined value or greater or not, a determination result storing step in which a determination result obtained by the potential determination step is stored in the memory means.

20. The inspection method of a defect state in the self light emitting display module according to claim 19, the reverse bias voltage applying step, the potential determination step, and the determination result storing step are respectively executed in all combinations of the respective scan lines and the respective data lines corresponding to the respective pixels.

* * * * *